US006998794B2

(12) United States Patent
Kim et al.

(10) Patent No.: US 6,998,794 B2
(45) Date of Patent: Feb. 14, 2006

(54) DEVICE AND METHOD FOR DRIVING ORGANIC EL DISPLAY

(75) Inventors: Hak Su Kim, Seoul (KR); Jong Geun Yoon, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 50 days.

(21) Appl. No.: 10/757,474

(22) Filed: Jan. 15, 2004

(65) Prior Publication Data

US 2004/0155593 A1 Aug. 12, 2004

(30) Foreign Application Priority Data

Jan. 17, 2003 (KR) ..... P10-2003-0003310

(51) Int. Cl.
*G05F 1/00* (2006.01)

(52) U.S. Cl. ..... 315/291; 315/307; 315/149; 315/158

(58) Field of Classification Search .. 315/169.1–169.3, 315/149, 158, 291, 307, 362; 345/63, 76, 345/77, 84, 204, 211, 589, 690
See application file for complete search history.

(56) References Cited

U.S. PATENT DOCUMENTS

| | | | | |
|---|---|---|---|---|
| 6,215,462 | B1 * | 4/2001 | Yamada et al. | 345/76 |
| 6,249,270 | B1 * | 6/2001 | Ito | 345/100 |
| 6,667,580 | B1 * | 12/2003 | Kim et al. | 315/169.3 |
| 6,690,117 | B1 * | 2/2004 | Komiya | 315/169.3 |
| 2001/0024361 | A1 * | 9/2001 | Suzuki et al. | 362/23 |
| 2002/0011978 | A1 * | 1/2002 | Yamazaki et al. | 345/87 |

* cited by examiner

*Primary Examiner*—Haissa Philogene
(74) *Attorney, Agent, or Firm*—Fleshner & Kim, LLP

(57) ABSTRACT

A device and method for driving an organic EL display is disclosed, in which the device includes a photo converter sensing an intensity of external light, and converting the sensed light to an electric signal; an A/D converter converting the electric signal of the photo converter from an analog signal to a digital signal; a comparator comparing the value of the electric signal converted to the digital signal with a preset reference value; a controller controlling at least any one of the driver and the power source according to comparison results; a driver controlling the amount of current applied to a display panel according to a control signal of the controller; and a power source controlling the intensity of voltage applied to the driver and the display panel according to the control signal of the controller.

8 Claims, 2 Drawing Sheets

DEVICE AND METHOD FOR DRIVING ORGANIC EL DISPLAY

This application claims the benefit of the Korean Application No. P2003-3310, filed on Jan. 17, 2003, which is hereby incorporated by reference.

BACKGROUND OF THE INVENTION

1. Field of the Invention

The present invention relates to a light-emitting device, and more particularly, a device and method for driving an organic EL (electroluminescence) display.

2. Discussion of the Related Art

In general, a light-emitting device emits light in itself when electricity or other energy is provided thereto. The light-emitting device is formed in various types such as an organic EL (electroluminescence) or an organic light-emitting diode, an inorganic light-emitting diode, an inorganic EL (electroluminescence), an FED (field effect display), and a PDP (plasma display panel).

The light-emitting device has greater visibility as luminous intensity becomes low. However, the light-emitting device has worse visibility as luminous intensity becomes high in the bright outside. Thus, the light-emitting device may have a plurality of control switches for changing luminance of display screen intermittently, or a control knob for changing luminance of display screen gradually. Accordingly, in case of the bright environment, a user can control the luminance of display screen by using the control switch or the control knob.

However, the light-emitting device according to the related art has the following disadvantages.

When driving the light-emitting device according to the related art, the user has to control the luminance of display screen according to the environment, thereby causing the user's inconvenience and time waste. Also, there is limitation in that it is impossible to sense the optimum luminance of display screen according to the environment with user's eyes.

SUMMARY OF THE INVENTION

Accordingly, the present invention is directed to a device and method for driving an organic EL display that substantially obviates one or more problems due to limitations and disadvantages of the related art.

An object of the present invention is to provide a device and method for driving an organic EL display to automatically control luminance of display screen according to intensity of external light, thereby obtaining great stability and visibility of the display screen, and low power consumption.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for driving an organic EL display includes a photo converter sensing an intensity of external light, and converting the sensed light to an electric signal; an A/D converter converting the electric signal of the photo converter from an analog signal to a digital signal; a comparator comparing the value of the electric signal converted to the digital signal with a preset reference value; a controller controlling at least any one of the driver and the power source according to comparison results; a driver controlling the amount of current applied to a display panel according to a control signal of the controller; and a power source controlling the intensity of voltage applied to the driver and the display panel according to the control signal of the controller.

At this time, the photo converter is formed of any one of a phototube, a photodiode, a phototransistor, and a photo conduction device.

Also, the reference value of the comparator is any one among a plurality of reference values having different current and voltage values.

Also, the controller controls the driver to increase the amount of current applied to the display panel when the value of the electric signal is larger than the reference value, and the controller controls the driver to decrease the amount of current applied to the display panel when the value of the electric signal is smaller than the reference value.

At this time, the display panel is in an active matrix type.

Also, the controller controls the driver to increase the amount of current applied to the display panel, and controls the power source to increase the intensity of voltage applied to the driver and the display panel when the value of the electric signal is larger than the reference value, and the controller controls the driver to decrease the amount of current applied to the display panel, and controls the power source to decrease the intensity of voltage applied to the driver and the display panel when the value of the electric signal is smaller than the reference value.

At this time, the display panel is in a passive matrix type.

In another aspect, a method for driving an organic EL display includes the steps of sensing an intensity of external light, and converting the sensed light to an electric signal; converting the electric signal from an analog signal to a digital signal; comparing the value of the electric signal converted to the digital signal with a preset reference value; and controlling at least any one of the driver and the power source according to comparison results so as to control the amount of current applied to the display panel.

At this time, when controlling the amount of current applied to the display panel, the driver is controlled to increase the amount of current applied to the display panel in case the value of the electric signal is larger than the preset reference value, and the driver is controlled to decrease the amount of current applied to the display panel in case the value of the electric signal is smaller than the preset reference value.

When controlling the amount of current applied to the display panel, in case the value of the electric signal is larger than the reference value, the driver is controlled to increase the amount of current applied to the display panel, and the power source is controlled to increase the intensity of voltage applied to the driver and the display panel, meanwhile, in case the value of the electric signal is smaller than the reference value, the driver is controlled to decrease the amount of current applied to the display panel, and the power source is controlled to decrease the intensity of voltage applied to the driver and the display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a device and method for driving an organic EL display according to the present invention will be described with reference to the accompanying drawings.

Figure 1:
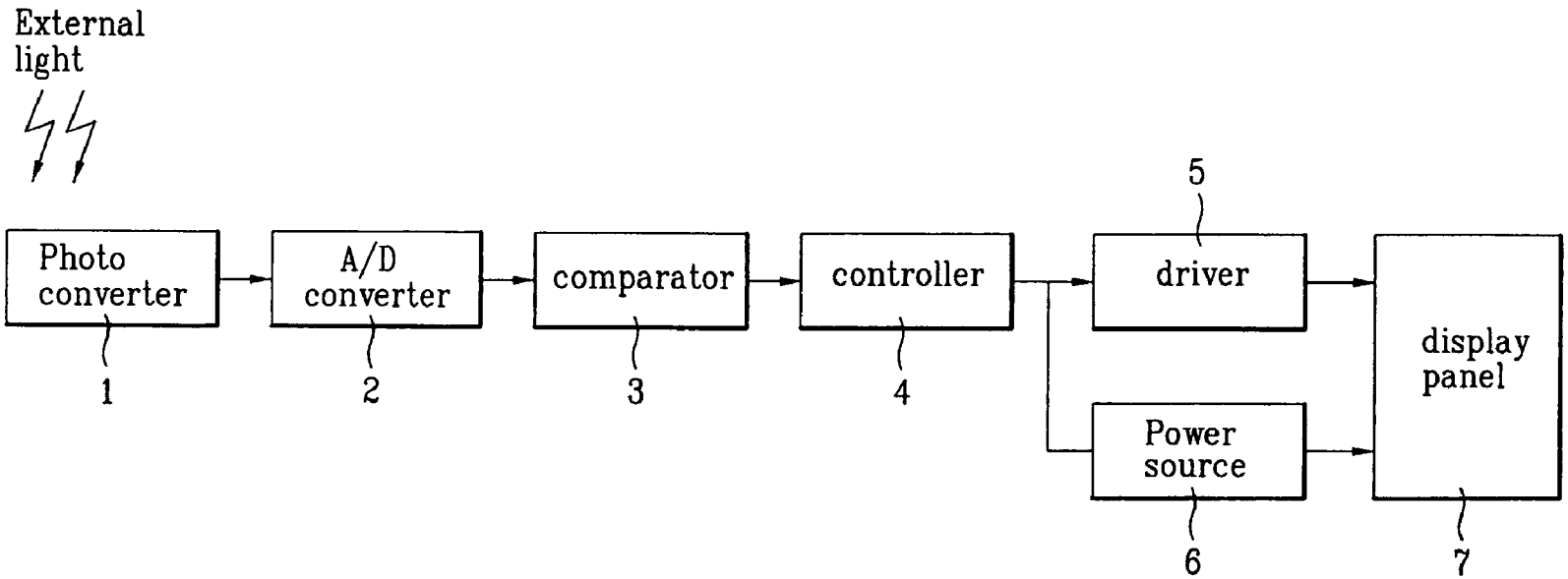
FIG. 1 is a block diagram illustrating a device for driving an organic EL display according to the present invention.

FIG. 1 is a block diagram illustrating a device for driving an organic EL display according to the present invention. As shown in FIG. 1, the device for driving the organic EL display according to the present invention includes a photo converter 1, an A/D converter 2, a comparator 3, a controller 4, a driver 5, a power source 6, and a display panel 7.

At this time, the photo converter 1 senses an intensity of external light, and converts the sensed light to an electric signal. In this case, the photo converter 1 is formed of any one of a phototube, a photodiode, a phototransistor and a photo conduction device. Then, the A/D converter 2 converts the electric signal of the photo converter 1 from an analog signal to a digital signal. Subsequently, the comparator 3 compares the value of the electric signal converted to the digital signal with a preset reference value. In this state, the preset reference value may be any one of a plurality of reference values having different current and voltage values.

Herein, the reference value may be preset in various modes. For example, a first reference value may be a first mode used in case the display panel is in the inside or the outside of the night, or may be a second mode used in case the display panel is in the bright inside or the rainy outside. Also, the second reference value may be a third mode used in case the display panel is the shaded outside with clouds, or may be a fourth mode used in case the intensity of light increases.

At this time, it is impossible to sense whether the environment of the display panel is in the inside/outside and the day/night with the present invention. Accordingly, the driver 5 and the power source 6 are controlled in a method of selecting any one mode among various modes by sensing the luminous intensity of the outside, and comparing the sensed result with the preset reference value. In this case, if the time is sensed with a clock mounted in a system or a signal inputted from the external, it is possible to sense whether the environment of the display panel is in the day or night, and to control the mode according to the sensed time. Herein, the mode classification is not limited to the aforementioned method, and the mode may be classified in the various methods.

Also, the display panel may be luminescent when applying the voltage thereto, or the display panel may be luminescent at needed. For example, in case of the first and second modes, the display panel is luminescent continuously. Meanwhile, in case of the third and fourth modes, the display panel is luminescent for a predetermined time period when a user desires to watch a screen. Accordingly, it is possible to obtain good visibility without power waste. If the function of the present invention may be applied to mobile electronic appliances such as mobile phones, it is possible to improve efficiency.

Then, the controller 4 controls at least any one of the driver 5 and the power source 6 according to comparison results. At this time, in case the value of the electric signal is larger than the preset reference value, the driver 5 is controlled to increase the amount of current applied to the display panel 7, thereby increasing the luminance of the display panel 7. Meanwhile, if the value of the electric signal is smaller than the preset reference value, the driver 5 is controlled to decrease the amount of current applied to the display panel 7, thereby decreasing the luminance of the display panel 7. In this case, the display panel 7 may be in an active matrix type.

When the value of the electric signal is larger than the preset reference value, the controller 4 controls the driver 5 to increase the amount of current applied to the display panel 7, and controls the power source 6 to increase the intensity of voltage applied to the driver 5 and the display panel 7, thereby increasing the luminance of the display panel 7. Also, if the value of the electric signal is smaller than the preset reference value, the controller 4 controls the driver 5 to decrease the amount of current applied to the display panel 7, and controls the power source 6 to decrease the intensity of voltage applied to the driver 5 and the display panel 7, thereby decreasing the luminance of the display panel 7. In this case, the display panel may be in a passive matrix type.

Then, the driver 5 controls the amount of current applied to the display panel 7 according to a control signal of the controller 4, so as to control the luminance of the display panel 7. The power source 6 controls the intensity of voltage applied to the driver 5 and the display panel 7 according to the control signal of the controller 4, so as to control the luminance of the display panel 7.

Figure 2:
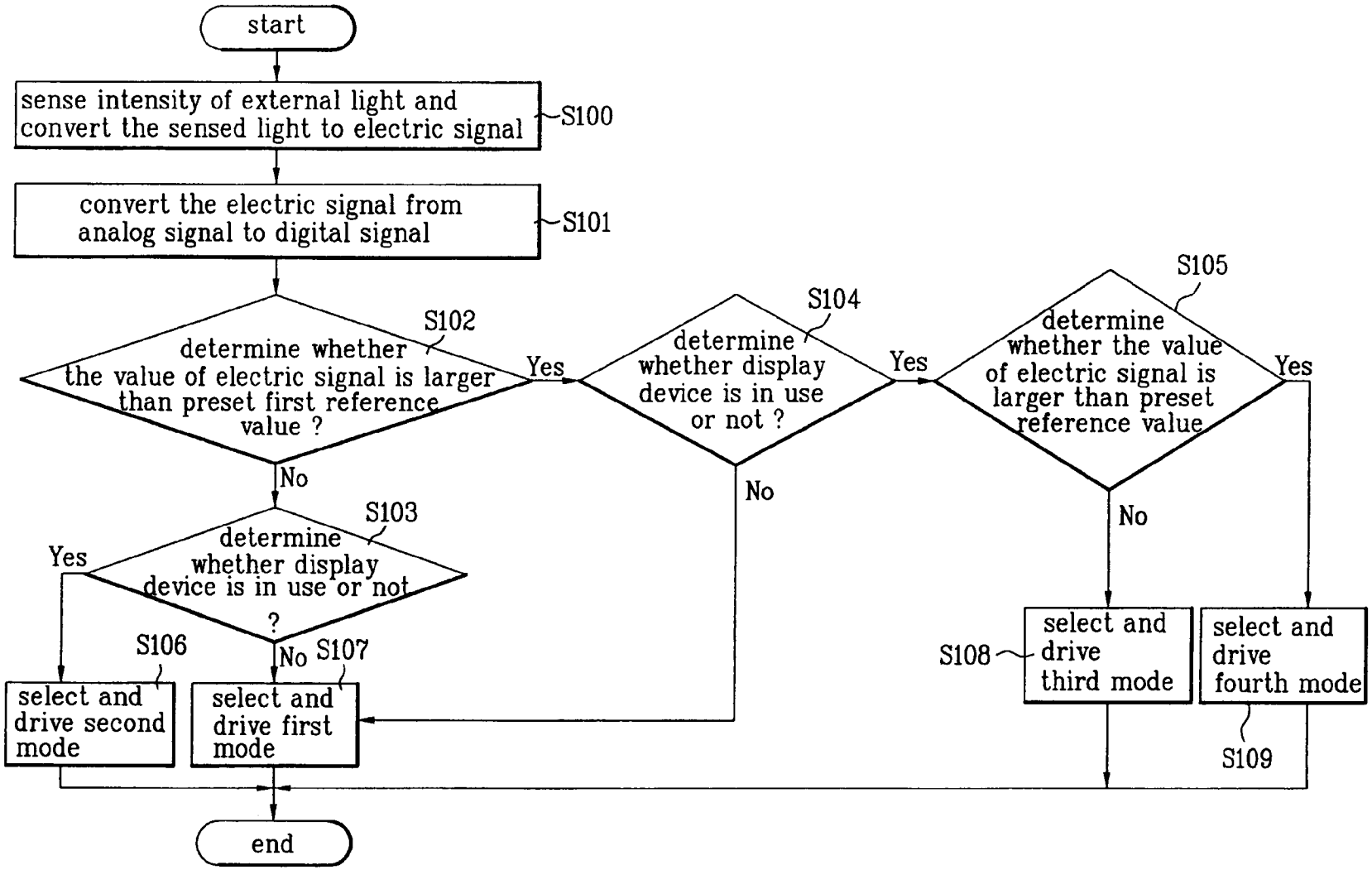
FIG. 2 is a flow chart illustrating a method for driving an organic EL display according to the present invention.

A method for driving the organic EL display according to the present invention will be described as follows. FIG. 2 is a flow chart illustrating a method for driving the organic EL display according to the present invention.

Referring to FIG. 2, the photo converter 1 senses the intensity of external light, and then converts the sensed light to the electric signal (S100). Subsequently, the A/D converter 2 converts the electric signal from the analog signal to the digital signal (S101).

Then, the comparator 3 compares the value of the electric signal with the preset first reference value (S102). For example, in case the preset first reference value is the mean value between the second and third modes, if the value of the electric signal is smaller than the first reference value, the first and second modes are selected. In this case, if the value of the electric signal is larger than the first reference value, the third and fourth modes are selected.

According to the comparison result, it is determined whether the selected mode is in use or not (S103, S104). At this time, if the first and second modes are not in use (S103), the first mode of the least power consumption is selected, whereby the driver 5 and the power source 6 are controlled for being corresponding to the first mode, thereby controlling the luminance of the display panel 7 (S107).

If the first and second modes are in use, the second mode is selected, and the driver 5 and the power source 6 are controlled for being corresponding to the second mode, thereby controlling the luminance of the display panel 7 (S106). Meanwhile, if the third and fourth modes are not in use (S104), the first mode of the least power consumption is selected, and the driver 5 and the power source 6 are controlled for being corresponding to the first mode, thereby controlling the luminance of the display panel 7 (S107).

If the third and fourth modes are in use (S104), it is required to compare the value of the electric signal with the preset second reference value (S105). According to the comparison result, if the value of the electric signal is smaller than the second reference value, the third mode is selected, and the driver 5 and the power source 6 are controlled for being corresponding to the third mode, thereby controlling the luminance of the display panel 7 (S108). If the value of the electric signal is larger than the second reference value, the fourth mode is selected, and the driver 5 and the power source 6 are controlled for being corresponding to the fourth mode, thereby controlling the luminance of the display panel 7 (S109).

As mentioned above, the luminance of the organic EL display panel is controlled by selecting the driving mode appropriate for the intensity of external light, whereby it is possible to decrease power consumption of the device, and to obtain great visibility. When it is applied to the mobile phone, the first mode is automatically selected in case the mobile phone is not in use, so that the display panel has the least luminance. In case the mobile phone is not in use, it is required for the user to watch only basic data such as the time and date.

When the mobile phone is used in the inside, the second mode is automatically selected to obtain the luminance of the display panel brighter than that of the first mode. If the mobile phone is used in the shaded or cloudy outside, the third mode is automatically selected to obtain the luminance of the display panel brighter than that of the second mode. In this case, since the display panel is in the slightly dark environment, the user can check the display panel with the less luminance.

Also, in case the mobile phone is used in the bright outside, the fourth mode is automatically selected to obtain the luminance of the display panel brighter than that of the third mode. Thus, when the outside has great luminous intensity, it is possible to prevent visibility of the display panel from lowering, thereby obtaining the user's convenience.

Also, the luminance of the display panel is controlled automatically according to the luminous intensity of light of the external environment, thereby obtaining great stability and visibility of the display screen, and long life span of battery in the mobile phone by the low power consumption. Furthermore, the driving mode may be classified in a detailed method according to the external environment so as to improve efficiency.

As mentioned above, the device and method for driving the EL display according to the present invention has the following advantages.

In the device and method for driving the EL display according to the present invention, when the luminous intensity of the external environment is great, the luminance of display panel is increased, thereby obtaining the low power consumption.

Also, the luminance of display panel is automatically controlled according to the change of the external environment, whereby it is possible for the user to obtain the stability on watching the display panel, thereby relieving user's eyestrain.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A device for driving an organic EL display having a driver and a power source for driving a display panel comprising:

a photo converter sensing an intensity of external light, and converting the sensed light to an electric signal;

an A/D converter converting the electric signal of the photo converter from an analog signal to a digital signal;

a comparator comparing the value of the electric signal converted to the digital signal with a preset reference value;

a controller controlling at least any one of the driver and the power source according to comparison results;

the driver controlling the amount of current applied to the display panel according to a control signal of the controller;

the power source controlling the intensity of voltage applied to the driver and the display panel according to the control signal of the controller; and wherein the controller controls the driver to increase the amount of current applied to the display panel when the value of the electric signal is larger than the reference value, and the controller controls the driver to decrease the amount of current applied to the display panel when the value of the electric signal is smaller than the reference value.

2. The device as claimed in claim 1, wherein the photo converter is formed of any one of a phototube, a photodiode, a phototransistor, and a photo conduction device.

3. The device as claimed in claim 1, wherein the reference value of the comparator is any one among a plurality of reference values having different current and voltage values.

4. The device as claimed in claim 1, wherein the controller controls the driver to increase the amount of current applied to the display panel, and controls the power source to increase the intensity of voltage applied to the driver and the display panel when the value of the electric signal is larger than the reference value, and the controller controls the driver to decrease the amount of current applied to the display panel, and controls the power source to decrease the intensity of voltage applied to the driver and the display panel when the value of the electric signal is smaller than the reference value.

5. The device as claimed in claim 1, wherein the display panel is in an active matrix type.

6. The device as claimed in claim 4, wherein the display panel is in a passive matrix type.

7. A method for driving an organic EL display having a driver and a power source for driving a display panel comprising:

sensing an intensity of external light, and converting the sensed light to an electric signal;

converting the electric signal from an analog signal to a digital signal;

comparing the value of the electric signal converted to the digital signal with a preset reference value;

controlling at least any one of the driver and the power source according to comparison results so as to control the amount of current applied to the display panel; and wherein the controller controls the driver to increase the amount of current applied to the display panel when the value of the electric signal is larger than the reference value, and the controller controls the driver to decrease the amount of current applied to the display panel when the value of the electric signal is smaller than the reference value.

8. The method as claimed in claim 7, wherein, when controlling the amount of current applied to the display panel, in case the value of the electric signal is larger than the reference value, the driver is controlled to increase the amount of current applied to the display panel, and the power source is controlled to increase the intensity of voltage applied to the driver and the display panel, meanwhile, in case the value of the electric signal is smaller than the reference value, the driver is controlled to decrease the amount of current applied to the display panel, and the power source is controlled to decrease the intensity of voltage applied to the driver and the display panel.

* * * * *